US005831516A

United States Patent [19]

Jennings

[11] Patent Number: 5,831,516

[45] Date of Patent: Nov. 3, 1998

[54] ELECTROMECHANICAL CHIME

[76] Inventor: David Jennings, P.O. Box 134, Needles, Calif. 92363

[21] Appl. No.: 909,612

[22] Filed: Aug. 13, 1997

[51] Int. Cl.[6] ..... G08B 3/00

[52] U.S. Cl. ..... 340/392.4; 340/392.1; 340/392.5; 340/393.2; 116/141

[58] Field of Search ..... 340/392.4, 392.1, 340/393.2, 393.4, 392.5, 395.1, 392.2, 693, 384.1, 407.1; 116/141; 84/404

[56] References Cited

U.S. PATENT DOCUMENTS

| | | | |
|---|---|---|---|
| D. 279,873 | 7/1985 | Neely | D10/116 |
| D. 285,669 | 9/1986 | Brockmann | D10/116 |
| 4,854,214 | 8/1989 | Lowe | 84/404 |
| 5,072,208 | 12/1991 | Christensen | 340/392.4 |
| 5,107,155 | 4/1992 | Yamaguchi | 340/407.1 |
| 5,208,578 | 5/1993 | Tury et al. | 340/392.2 |
| 5,369,391 | 11/1994 | Gadsby | 340/392.5 |
| 5,452,638 | 9/1995 | Yancy | 84/404 |
| 5,473,307 | 12/1995 | Lam | 340/392.4 |
| 5,561,413 | 10/1996 | Ashibe et al. | 340/392.1 |
| 5,648,624 | 7/1997 | Smith | 84/404 |
| 5,682,132 | 10/1997 | Hiroyoshi et al. | 340/407.1 |

*Primary Examiner*—Thomas J. Mullen, Jr.
*Assistant Examiner*—Sihong Huang

[57] ABSTRACT

The present invention relates to an electromechanical wind chime. The chime includes a disk from which a hammer assembly is suspended. Additionally, a plurality of tubular chimes are suspended from the disk and surround the hammer assembly. The hammer assembly houses an internal electric motor, and an associated eccentric rotor. The motor serves to move the assembly about a central axis. In this manner, the hammer assembly comes into contact with the chimes to produce a pleasing sound. A control unit is coupled to the hammer assembly by way of an electric cord. The control unit includes means to control the current being delivered to the electric motor. Through the control unit the current can be shut off after a predetermined amount of time has elapsed. Additionally, the unit can alternate the frequency with which the current is delivered to produce a more random motion. An embodiment employing a solenoid in place of an electric motor is also disclosed.

7 Claims, 5 Drawing Sheets

ELECTROMECHANICAL CHIME

BACKGROUND OF THE INVENTION

1. Field of the Invention

The present invention relates to an electromechanical wind chime and more particularly pertains to such a chime with a non-linear chiming effect.

2. Description of the Prior Art

The use of wind chimes is known in the prior art. More specifically, wind chimes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,369,391 to Gadsby discloses a sun powered electrically operated chime apparatus. U.S. Pat. No. 5,072,208 to Christensen discloses an electromechanical chaotic chiming mechanism. U.S. Pat. No. 5,473,307 to Lam discloses a transducer apparatus responsive to external perturbation. U.S. Pat. No. 5,208,578 to Tury discloses a light powered chime. U.S. Pat. No. 5,452,638 to Yancy discloses a multiple tone wind chime. U.S. Design Patent 279,873 to Neeley discloses a musical wind chime. Lastly, U.S. Design Patent 285,669 to Brockmann discloses the design of a wind chime.

In this respect, the wind chime of the present invention substantially departs from the conventional concepts and designs of the prior art, and in so doing provides an apparatus primarily developed for the purpose of driving an electromechanical wind chime in a non-linear chaotic fashion.

Therefore, it can be appreciated that there exists a continuing need for improved wind chimes. In this regard, the present invention substantially fulfills this need.

SUMMARY OF THE INVENTION

In view of the foregoing disadvantages inherent in the known types of wind chimes now present in the prior art, the present invention provides a wind chime that may be driven in a windless environment. As such, the general purpose of the present invention, which will be described subsequently in greater detail, is to provide for the mechanical control of a wind chime.

To attain this, the present invention comprises an electromechanical wind chime. The chime includes a disk from which a hammer assembly is suspended. Additionally, a plurality of tubular chimes are suspended from the disk and surround the hammer assembly. The hammer assembly houses an internal electric motor, and an associated eccentric rotor to provide for electromechanical control while minimizing the need to modify the overall appearance of a standard wind chime assembly. The motor serves to move the assembly about a central axis. In this manner, the hammer assembly comes into contact with the chimes to produce a pleasing sound. A control unit is coupled to the hammer assembly by way of an electric cord. The control unit includes means to control the current being delivered to the electric motor. Through the control unit the current can be shut off after a predetermined amount of time has elapsed. Additionally, for a direct current source, the unit can alternate the frequency with which the current is delivered to produce a more random motion. An embodiment employing a solenoid in place of an electric motor is also disclosed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electromechanical wind chime. The chime includes a suspension disk having an upper surface, a lower surface, and a peripheral area. A length of cord is secured to the upper surface of the disk, with the cord adapted to suspend the suspension disk from a ceiling. A plurality of elongated tubular chimes are each suspended from the peripheral lower surface of the disk by way of a chord. A hammer assembly is included and has an outer circular housing, and an electric motor positioned within the outer circular housing. The motor is adapted for rotation therein. An asymmetrical rotor is integral with, and rotates with, the electric motor. Additionally, a magnet is secured to an outer surface of the asymmetrical rotor. A hammer weight is secured to the outer circular housing, with a magnet secured to an internal surface of the hammer weight. Thus, rotation of the asymmetrical rotor results in the circular movement of the hammer assembly. A second length of cord serves to interconnect the lower surface of the suspension disk to the hammer assembly. A control unit, with a direct current supply positioned therein, is adapted to supply current to the electric motor. The control unit includes a current control means for alternating the supply of current to the electric motor, and a timing control means for disengaging the supply of current to the electric motor after a set amount of time. An electric cord serves to interconnect the control unit and the hammer assembly. This electric cord functioning to deliver current to the electric motor and to suspend the control unit.

It is also an object of the present invention to provide a wind chime which minimizes deviations to the appearance of a standard wind chime assembly.

It is another object of the present invention to provide an electromechanical wind chime that can be hung in a conventional manner.

It is a further object of the present invention to provide a wind chime that can be enjoyed indoors and out of doors.

An even further object of the present invention is to provide a wind chime which is susceptible of a low cost of manufacture with regard to both materials and labor, and which accordingly is then susceptible of low prices of sale to the consuming public, thereby making such wind chimes economically available to the buying public.

Still yet another object of the present invention is to provide a wind chime which provides in the apparatuses and methods of the prior art some of the advantages thereof, while simultaneously overcoming some of the disadvantages normally associated therewith.

Still another object of the present invention is to provide a mechanical wind chime that can be set to operate at various times.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

The present invention relates to an electromechanical wind chime. The chime includes a disk from which a hammer assembly is suspended. Additionally, a plurality of tubular chimes are suspended from the disk and surround the hammer assembly. The hammer assembly houses an internal electric motor, and an associated eccentric rotor. The motor serves to move the assembly about a central axis. In this manner, the hammer assembly comes into contact with the chimes to produce a pleasing sound. A control unit is coupled to the hammer assembly by way of an electric cord. The control unit includes means to control the current being delivered to the electric motor. Through the control unit the current can be shut off after a predetermined amount of time has elapsed. Additionally, for a direct current source, the unit can alternate the frequency with which the current is delivered to produce a more random motion. An embodiment employing a solenoid in place of an electric motor is also disclosed. The various components of the present invention, and the manner in which they interrelate, will be described in greater detail hereinafter.

Figure 1:
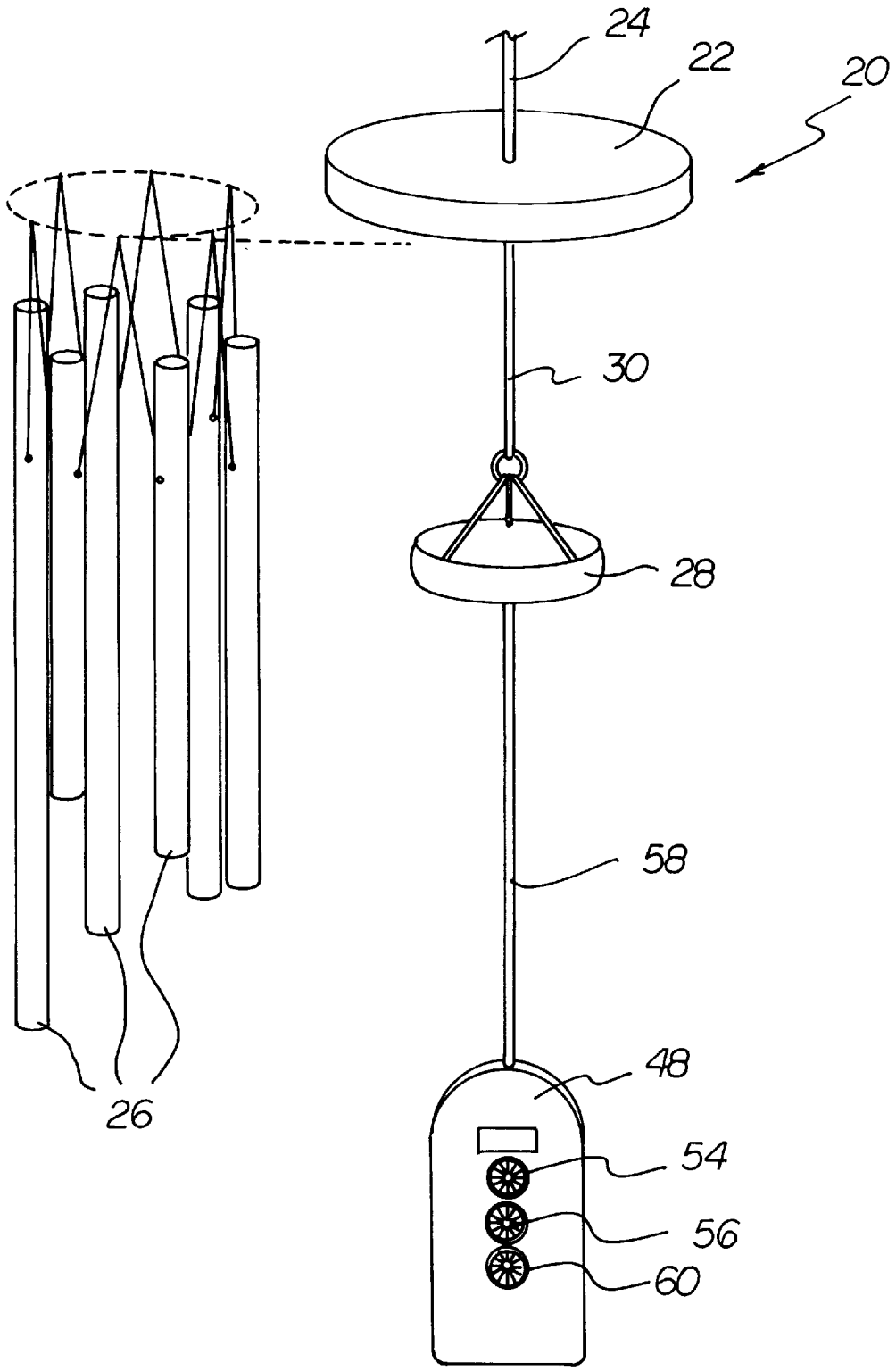
FIG. 1 is a partially exploded view of the wind chime of the present invention.

With reference to FIG. 1, the wind chime 20 includes a suspension disk 22. This disk 22 is defined by an upper surface, a lower surface, and a peripheral area. This suspension disk 22 is designed to be hung from a ceiling by way of a length of cord 24. The cord 24 is secured to the upper surface of the disk 22 at a central location. With continuing reference to FIG. 1, a plurality of elongated tubular chimes 26 are suspended from the disk 22. More specifically, each of the chimes 26 are suspended from the peripheral lower surface of the disk 22 by way of a chord. Although the chimes 26 have been described as elongated and tubular, other chime configurations can be employed in conjunction with the present invention.

Figure 3:
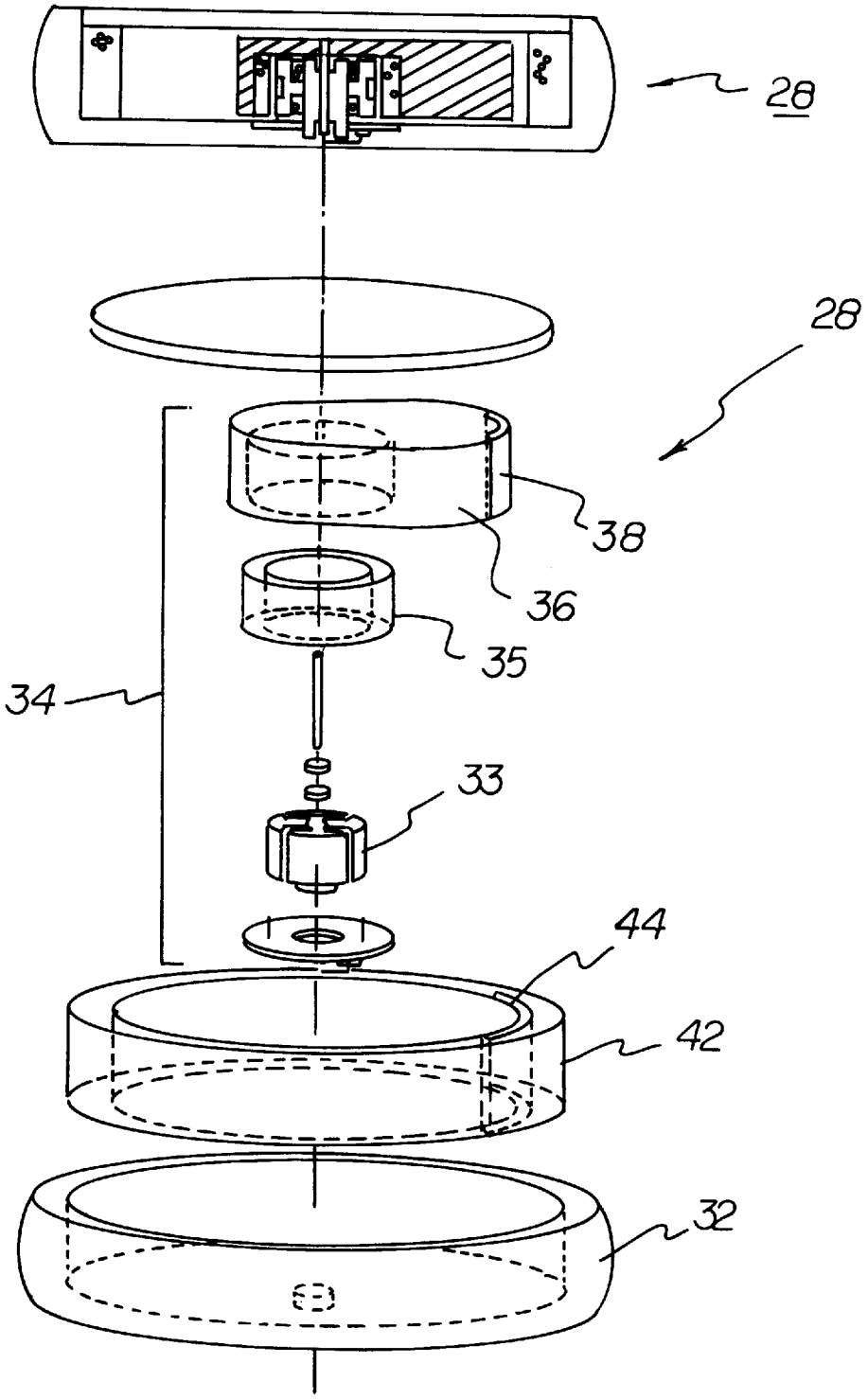
FIG. 3 is an exploded view of the motor driven hammer assembly of the present invention.

In a windless environment the chimes 26 can be made to produce sounds by way of an electric hammer assembly 28. An exploded view of the primary embodiment of this hammer assembly 28 is depicted in FIG. 3. A second length of cord 30 serves to interconnect the lower surface of the suspension disk 22 to the hammer assembly 28. The hammer assembly 28 provides for the electromechanical control of the entire wind chime. As illustrated in FIG. 1, the hammer assembly is supported in a triangular fashion. Specifically, the length of cord 30 is secured to the top of the hammer assembly at three locations. In this manner the eccentrically weighted hammer can be supported horizontally.

The hammer assembly 28 consists of an outer circular housing 32. An electric motor assembly 34 is positioned within the outer circular housing 32 and includes rotor 36 and stator 33. Asymmetrical rotor 36 forms an integral part of the motor 34. Rotor magnet 35, in turn, forms an integral part of the rotor 36. The rotor 36 is asymmetrical with respect to the central axis of the hammer assembly 28. In other words, the rotor 36 has a center of gravity which is off-set with respect to the center of gravity of the remainder of the hammer assembly 28. A hammer weight 42 and outer circular housing 32 make up the additional components of the hammer assembly 28. Ultimately, the rotation of asymmetrical rotor 36 imparts a circular swinging motion to the entire hammer assembly 28. A random motion is achieved as the hammers motion is impeded by collisions with the individual chime elements 26. In general, the intensity of the hammering effect is directly proportional to the applied voltage and the randomness of the hammering is enhanced by supplying the electric current in pulses of "on" and "off" cycles. The weight of the entire hammer assembly 28 provides sufficient inertia to enable the hammer assembly 28 to continue to strike the chimes during "off" cycles of the electric current. The hammer weight 42 is provided because of the void space within the housing 32. Additionally, the housing 32 can be constructed from wood, or other light weight materials, and still have sufficient inertia due to the presence of the hammer weight 42. The present invention can also employ other types of motors. Namely, motor assemblies with internal rotors and external stators can be used within the hammer assembly 28.

In the preferred embodiment, the hammer assembly also employs two magnets. More specifically, a magnet 38, or ferric metal plate, is secured to an outer surface of the asymmetrical rotor 36. Additionally, one or more magnets 44 is secured to an internal surface of the hammer weight 42. The use of these magnets provides a more "linear" motion to the hammer assembly 28. Namely, during the first half of the rotor 36 rotation the magnetic force serves to increase the rotor's rotational speed. Then during the second half of the rotor 36 rotation the magnet force serves to decrease the rotor's rotational speed. The end result is a more linear movement which more closely mimics wind driven chimes. The common sound of a wind chime is typically produced by a "linear" breeze. In the absence of the above described magnet, the instantaneous control of power input of the electronic controller can be adjusted to make the hammer swing in a more linear path by timing the power pulses to match the natural frequency of the hammer/pendulum assembly.

Figure 2:
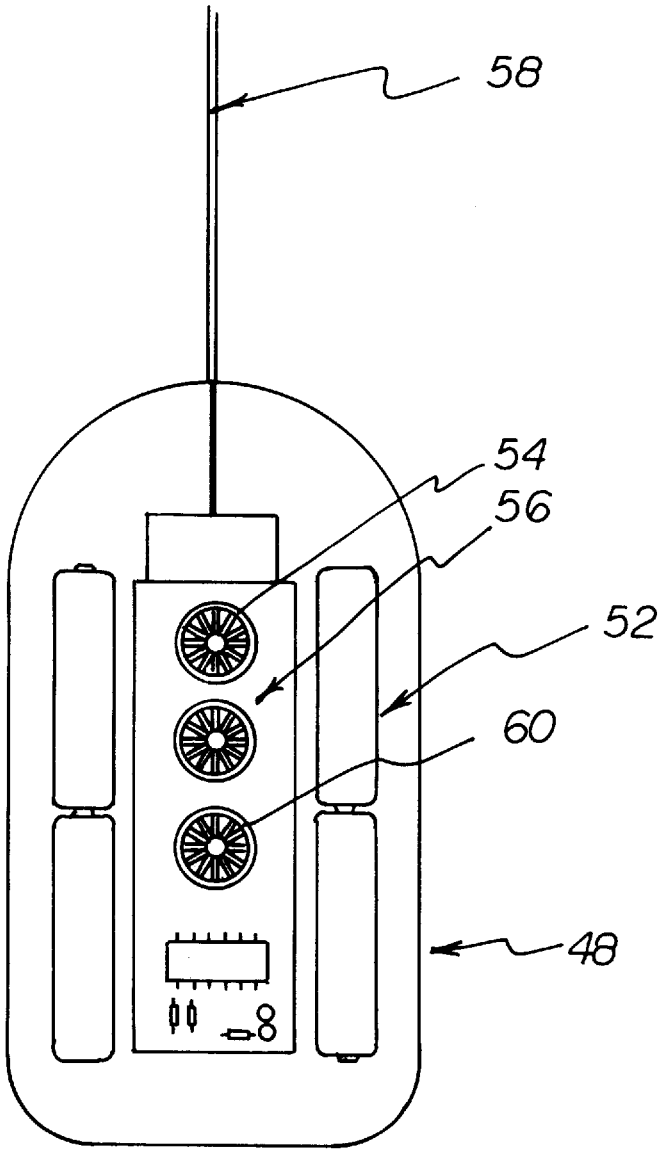
FIG. 2 is a view of the control unit of the present invention.

The hammer assembly 28 is controlled by way of a control unit 48. The control unit 48 is illustrated in FIG. 2. In the preferred embodiment a direct current supply 52 is positioned within the control unit 48. However, the wind chime 20 of the present invention can also be powered by an external source of power such as the AC power from a wall outlet. Alternatively, an electric power source can be installed within the suspension disk 22. The direct current source 52 within the control unit is adapted to supply current to the electric motor 34 by way of an electric cord 58 from which the control unit 48 is suspended. The electric cord 58 interconnects the control unit 48 and the hammer assembly 28 and delivers current to the electric motor 34.

In the preferred embodiment the control unit 48 includes a current control means 54. This current control means 54 serves to alternate the supply of current to the electric motor 34. Through this control means 54, the power to the electric motor 34 can be cycled "off" and "on". Such cycling of the current results in a random chaotic motion of the hammer assembly 28, and thus a random chiming. Additionally, the control unit 48 includes a timing control means 56. The timing control means 56 allows for disengaging the supply of current to the electric motor 34 after a set amount of time. Through this control means the chime 20 of the present invention can be set to operate for a pre-selected period of time. A third control 60 can be employed to control the speed at which the rotor rotates. Additionally, the control unit can employ additional controls. For example, the unit can include an override function that would allow the chime to operate continuously at an alternative sound level.

Figure 4:
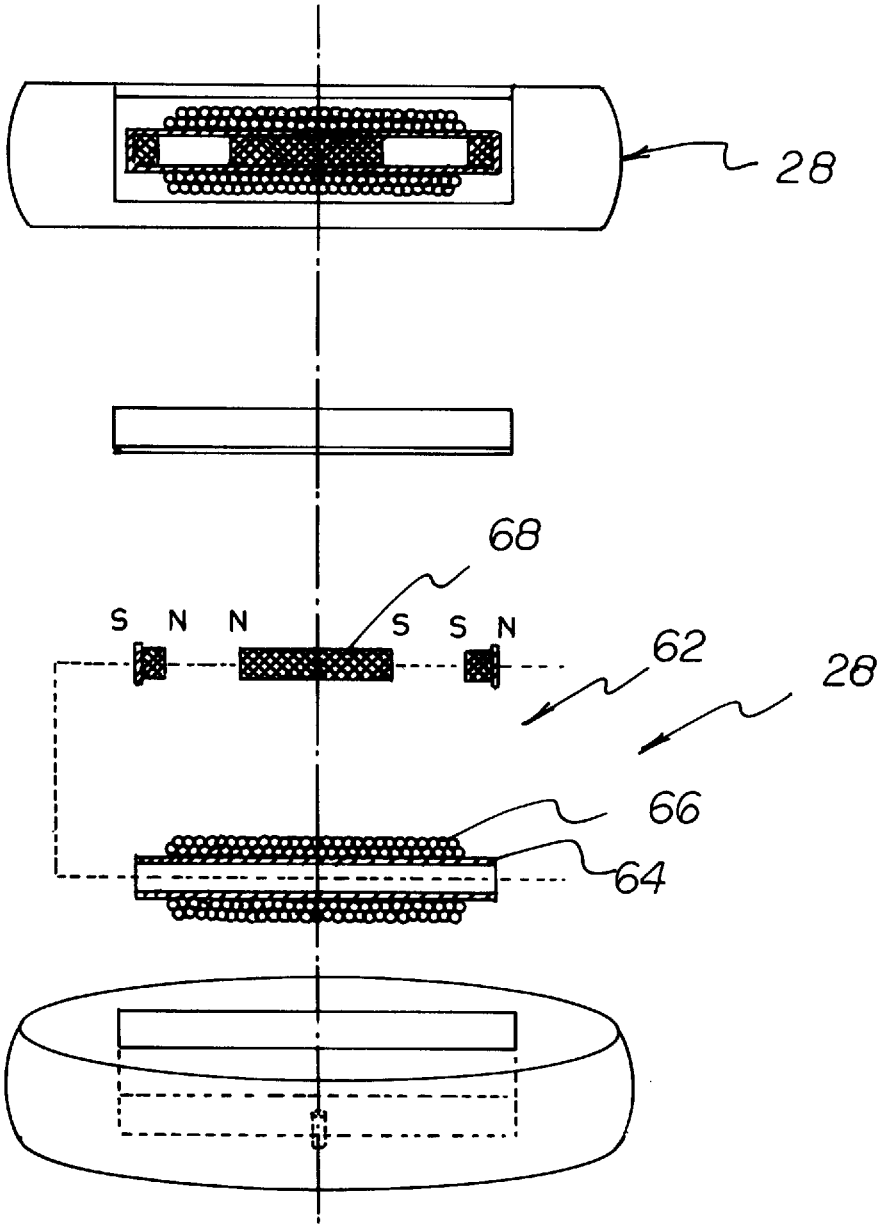
FIG. 4 is an exploded view of the solenoid driven hammer assembly of the present invention.
Figure 5:
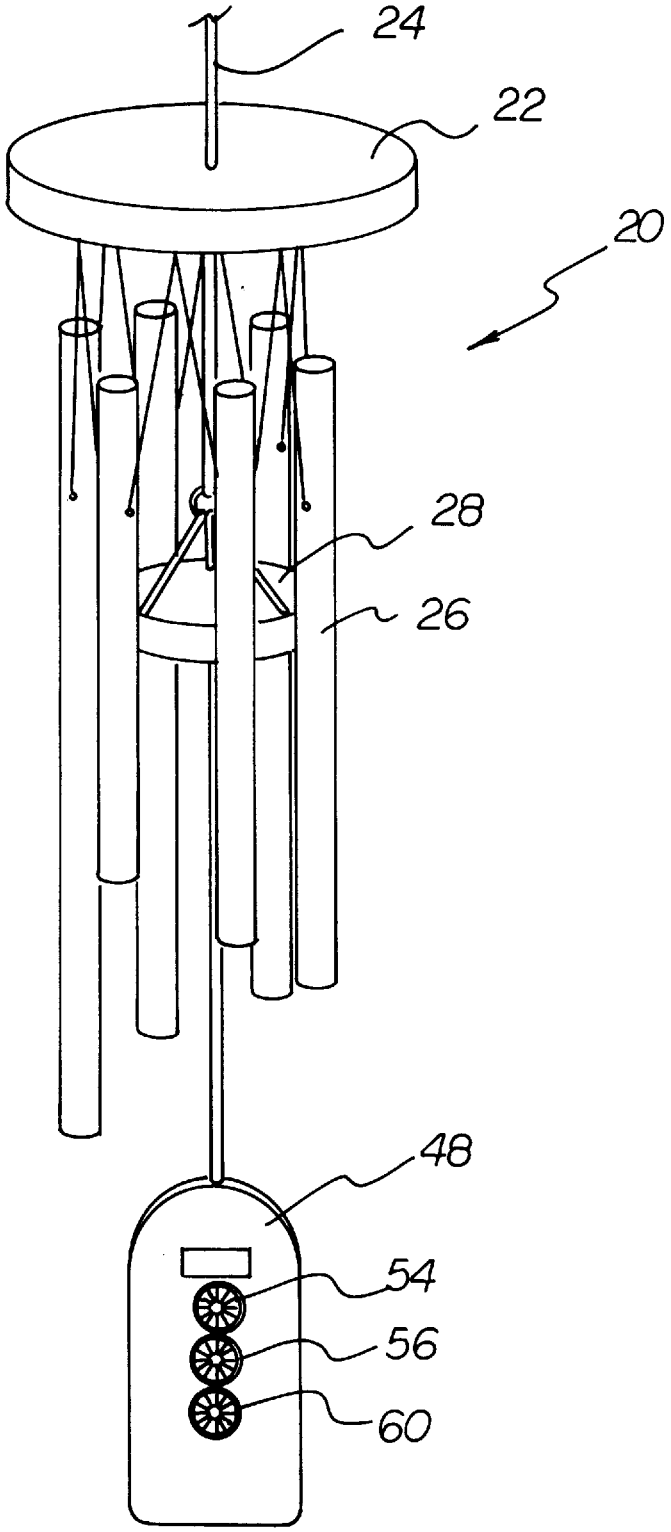
FIG. 5 is a perspective view of the wind chime of the present invention.

An alternative embodiment of the present invention employs a solenoid 62 in place of the above described electric motor. In all other aspects the operation of the chime remains the same. Namely, the solenoid 62 is similarly controlled by the above described control unit. An exploded view of the hammer assembly employing the solenoid 62 is depicted in FIG. 4. The electric solenoid 62 is positioned within the outer circular housing and is adapted for linear movement therein. More specifically, the solenoid 62 includes a housing 64 about which a number of coils 66 are wound. Current passing through the coils 66 sets up a magnetic field within solenoid housing 64. Each end of the housing 64 is enclosed by a magnet. These two magnets are of opposite polarities. The magnetic solenoid plunger 68 is thus oscillated by alternating the current within coils 66. Thus, alternating the current within the coils 66 results in the oscillating movement of the solenoid plunger 68. The movement of the plunger 68, in turn, results in the linear movement of the hammer assembly 28. This linear movement better approximates the movement achieved by the wind. In either of the above described embodiments, the chime can be turned off and left to operate as a conventional wind chime.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electromechanical wind chime comprising in combination:

a suspension disk having an upper surface, a lower surface, and a peripheral area, a length of cord secured to the upper surface of the disk, the cord adapted to suspend the suspension disk from a ceiling;

a plurality of elongated tubular chimes, each of the chimes being suspended from the peripheral lower surface of the disk by way of a chord;

a hammer assembly having an outer circular housing, an electric motor position within the outer circular housing, an asymmetrical rotor forms a part of the electric motor, a magnet secured to an outer surface of the asymmetrical rotor, a hammer weight secured within the outer circular housing, a magnet secured to an internal surface of the hammer weight, rotation of the asymmetrical rotor resulting in the circular movement of the hammer assembly;

a second length of cord interconnecting the lower surface of the suspension disk to the hammer assembly;

a control unit having a direct current supply positioned therein and adapted to supply current to the electric motor, a current control means for alternating the supply of current to the electric motor, a timing control means for disengaging the supply of current to the electric motor after a set amount of time;

an electric cord interconnecting the control unit and the hammer assembly, the electric cord functioning to deliver current to the electric motor.

2. An electromechanical wind chime comprising in combination:

a suspension disk having an upper surface, a lower surface, and a peripheral area, a length of cord secured to the upper surface of the disk, the cord adapted to suspend the suspension disk from a ceiling;

a plurality of elongated chimes, each of the chimes being suspended from the peripheral lower surface of the disk by way of a chord;

a hammer assembly having an outer circular housing, an electric motor and associated rotor positioned within the outer circular housing and adapted for rotation therein, rotation of the rotor resulting in the movement of the hammer assembly;

a second length of cord interconnecting the lower surface of the suspension disk to the hammer assembly;

a control unit adapted to control the operation of the electric motor;

an electric cord interconnecting the control unit and the hammer assembly, the electric cord functioning to deliver current to the electric motor.

3. The electromechanical wind chime as described in claim 2 wherein:

the control unit has a direct current supply positioned therein and is adapted to supply current to the electric motor, the control unit further including a current control means for alternating the supply of current to the electric motor, and a timing control means for disengaging the supply of current to the electric motor after a set amount of time.

4. The electromechanical wind chime assembly as described in claim 2 further comprising:

an asymmetrical rotor interconnected to and adapted for rotation with the electric motor, a hammer weight secured within the outer circular housing, rotation of the electric motor and asymmetrical rotor resulting in the circular movement of the hammer assembly.

5. The electromechanical wind chime as described in claim 3 further comprising:

a magnet secured to an outer surface of the asymmetrical rotor; and a magnet secured to an internal surface of the hammer weight, the magnet of the rotor being effected by the magnet of the hammer weight to enable a more linear movement of the entire hammer assembly.

6. An electromechanical wind chime comprising in combination:

a suspension disk having an upper surface, a lower surface, and a peripheral area, a length of cord secured to the upper surface of the disk, the cord adapted to suspend the suspension disk from a ceiling;

a plurality of elongated chimes, each of the chimes being suspended from the peripheral lower surface of the disk by way of a chord;

a hammer assembly having an outer circular housing, an electric solenoid positioned within the outer circular housing and adapted for linear movement therein, the movement of the solenoid resulting in the movement of the hammer assembly;

a second length of cord interconnecting the lower surface of the suspension disk to the hammer assembly;

a control unit adapted to control the operation of the electric solenoid;

an electric cord interconnecting the control unit and the hammer assembly, the electric cord functioning to deliver current to the electric solenoid.

7. The electromechanical wind chime as described in claim 6 wherein:

the control unit has a direct current supply positioned therein and is adapted to supply current to the solenoid, the control unit further including a current control means for alternating the supply of current to the solenoid, and a timing control means for disengaging the supply of current to the solenoid after a set amount of time.

* * * * *